US005462296A

United States Patent [19]

Pozzobon

[11] Patent Number: 5,462,296

[45] Date of Patent: Oct. 31, 1995

[54] BRAKING DEVICE PARTICULARLY FOR SKATES

[75] Inventor: Alessandro Pozzobon, Paderno Di Ponzano Veneto, Italy

[73] Assignee: Nordica S.p.A., Montebelluna, Italy

[21] Appl. No.: 184,705

[22] Filed: Jan. 21, 1994

[30] Foreign Application Priority Data

Jan. 29, 1993 [IT] Italy ..... TV93A0009

[51] Int. Cl.[6] ..... A63C 17/14; A63C 17/06

[52] U.S. Cl. ..... 280/11.2; 280/11.22; 280/11.33; 188/5

[58] Field of Search ..... 188/5, 22, 23; 280/11.2, 11.19, 11.22, 11.25, 11.3, 11.33

[56] References Cited

U.S. PATENT DOCUMENTS

| | | | |
|---|---|---|---|
| 1,497,224 | 6/1924 | Ormiston | 280/11.2 |
| 3,224,785 | 12/1965 | Stevenson | 280/11.2 |
| 4,275,895 | 6/1981 | Edwards | 280/11.2 |
| 4,298,209 | 11/1981 | Peters | 280/11.2 |
| 5,183,275 | 2/1993 | Hoskin | 188/5 X |

FOREIGN PATENT DOCUMENTS

| | | |
|---|---|---|
| 0567948 | 11/1993 | European Pat. Off. . |
| 0585764 | 3/1994 | European Pat. Off. . |

*Primary Examiner*—Robert J. Oberleitner
*Assistant Examiner*—Peter M. Poon

[57] ABSTRACT

Braking device particularly usable for skates including a shoe composed of at least one quarter articulated to a shell associated with a supporting frame for two or more wheels. The device includes a rod member which is connected to a braking element and has a kinematic system suitable to allow the rotation of the quarter without activating the braking element, so as to allow to deactivate the braking element while skating or allow rear-entry insertion of the foot if the skate is of the rear-entry type. A locking element is provided for locking the kinematic system and/or the devices for deactivating the braking element.

24 Claims, 5 Drawing Sheets

BRAKING DEVICE PARTICULARLY FOR SKATES

BACKGROUND OF THE INVENTION

The present invention relates to a braking device particularly usable for skates having a shoe composed of at least one quarter articulated to a shell associated with a supporting frame for two or more wheels.

In conventional roller skates, whether constituted by a shoe associated with a support for two pairs of mutually parallel wheels or by a shoe associated with a supporting frame for two or more aligned wheels, there is the problem of braking the wheels to adjust the speed of the skate.

It is known to use adapted blocks or pads, usually made of rubber, which are arranged at the toe or heel region of the shoe; when the user tilts it forwards or backwards, the free end of the blocks or pads interacts with the ground and braking is thus achieved.

However, these solutions are not satisfactory, as they require the user to rotate the shoe, and thus the frame associated therewith, at the toe or heel, and this can cause loss of balance with consequent falls.

U.S. Pat. No. 1,402,010 discloses a roller skate having a band securable on the user's leg above the malleolar region; a rod is connected to the band.

The rod surrounds the leg to the rear and is then curved so as to laterally affect the leg until it is associated at its ends, in the malleolar region, with a lever system articulated to a structure protruding from the wheel supporting frame.

The lever system protrudes to the rear of the frame and is connected to a plate which is shaped approximately complimentary to the curvature of part of an underlying and facing wheel.

This solution is not free from drawbacks: first of all, a relative movement between the band and the leg is produced throughout sports practice, and this does not make its use comfortable due to the continuous rubbing of the band on the leg.

Furthermore, the plate is activated every time the user bends his leg backwards beyond a given angle, with no real and easy possibility of varying this condition.

Since the shape of the leg is different for each user, for the same rod length there is a different braking at different rotation angles.

Furthermore, the rod acts and presses in the malleolar region, and this can cause discomfort or accidental impacts. Finally, the wheel wears out considerably.

U.S. Pat. No. 4,275,895 provides a partial solution to this drawback, and discloses a brake for skates having two pairs of mutually parallel wheels which acts at the rear wheels.

The brake is constituted by a tongue associated with the shoe at the rear; a plate is associated with the tongue in a rearward position and is pivoted at the supporting frame for the shoe.

The plate has, at its free end, a transverse element and a pair of C-shaped elements is formed at its lateral ends. Following a backward rotation imparted to the tongue, the C-shaped elements interact with the rear wheels facing them, so as to interact with the rolling surface thereof.

Even this solution, however, has drawbacks: it is in fact structurally complicated and thus difficult to industrialize. In fact adapted springs are necessary for allowing the tongue to return to the position in which the C-shaped elements do not interact with the wheels, furthermore increasing the structural complexity.

Furthermore, the structural configuration of the brake causes the C-shaped elements to interact with the wheel even upon a minimal backward rotation imparted to the flap and thus even for involuntary movements, and this produces unwanted braking actions and the possible loss of balance or lack of coordination.

Finally, interaction of the C-shaped elements at the rolling surface of the wheels leads to the rapid wear of the wheels and thus to non-optimum rolling which necessarily entails continuous replacement of the wheels.

U.S. Pat. No. 4,300,781 discloses a braking device for skates that comprise pairs of mutually parallel wheels.

A brake is provided, constituted by a plate transversely pivoted at the rear end of the supporting frame for a shoe. Pads are associated with the end of the plate. The pads face the rolling surface of the pair of rear wheels.

The brake is activated by using a cable which is suitable to rotate the plate, in contrast with a spring associated with the support for the pair of front wheels, so as to move the pads into contact with the rolling surface of the pair of rear wheels.

The cable can be activated by means of rings or handles associated with a band arrangeable on the user's legs by virtue of temporary connection means.

However, this solution has considerable drawbacks: first of all, brake activation can lead to possible loss of balance during sports practice, because the user does not assume, with his body, a position suitable to control sudden speed reduction; only the hand of the skater is in fact involved in the brake activation.

Furthermore, as sports practice can occur while wearing trousers, when the rings are pulled the band may slip along the trousers or pull them so that they slide along the leg, hindering the braking action.

Finally, there is a loose cable which, in addition to being a hindrance to the skater, can accidentally catch during skating, especially since coordination of the arm-legs movement places the legs rhythmically laterally outwards.

SUMMARY OF THE INVENTION

The aim of the present invention is to solve the above described technical problems, eliminating the drawbacks of conventional skates, providing a braking device for skates which is structurally very simple, easy to industrialize and can be activated by the user in case of actual need and never accidentally, despite allowing optimum and easy insertion of the foot in the skate.

Another important object is to provide a braking device which can be activated rapidly, simply and safely by the user without forcing him/her to perform movements, for example with his/her hands, that might compromise balance or coordination.

Another important object is to provide a braking device which reduces the wear of the rolling surface of the wheels.

Another object is to provide a device which allows each individual user to select the degree of activation of the braking action according to specific requirements and to deactivate it easily at all times before skating.

Another object is to provide a device which associates with the preceding characteristics that of being reliable and safe in use, has low manufacturing costs and can also be applied to conventional skates.

With these and other objects in view, there is provided, according to the present invention, a braking device particularly for skates that comprise a shoe composed of at least one quarter articulated to a shell associated with a supporting frame for a plurality of wheels, characterized in that it comprises at least one rod member connected to a braking element, said rod member being operatively connected to said quarter through a kinematic means, said braking element being adapted to interact with a braking surface upon a rotation of said quarter, said kinematic means being suitable to allow the rotation of said at least one quarter without activating said braking element against said braking surface at least during use of said skate, locking means being provided for locking said kinematic means and deactivating said braking element.

BRIEF DESCRIPTION OF THE DRAWINGS

Further characteristics and advantages of the present invention will become apparent from the following detailed description of some particular but not exclusive embodiments thereof, illustrated only by way of non-limitative example in the accompanying drawings, wherein.

DESCRIPTION OF THE PREFERRED EMBODIMENTS

Figure 1:
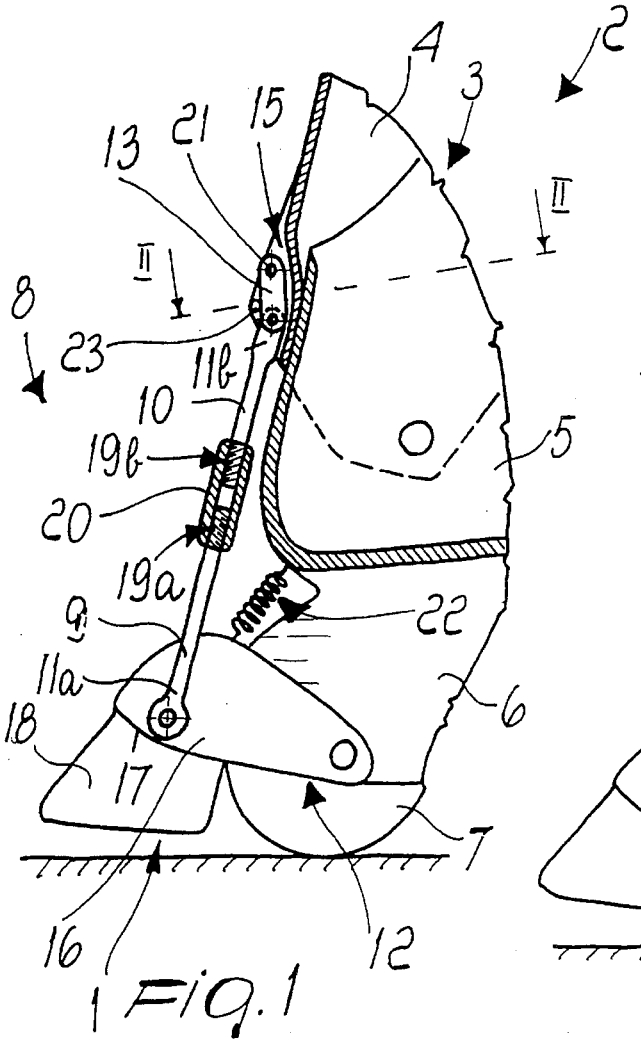
FIG. 1 is a partially sectional side view of the braking device associated with the skate.

With reference to the above figures, the reference numeral 1 designates the braking device, which is particularly usable for skates, generally designated by the reference numeral 2.

Said skates comprise a shoe 3 composed of a quarter 4 that surrounds the lower part of the user's leg and is articulated to a shell 5 with which a frame 6 is associated in a lower region, said frame supporting two or more possibly mutually aligned wheels designated by the reference numeral 7. Conventional securing levers may be applied to the quarter 4 and the shell 5.

The braking device comprises at least one rod member, generally designated by the reference numeral 8, which is arranged to the rear of the shoe 3; said rod member 8 is advantageously constituted by a first arm 9 and by a second arm 10, which have a first end 11*a*, 11*b* pivoted respectively to an underlying braking element 12, oscillatably articulated to the frame 6 and to a link 13, which is in turn pivoted to the rear of the quarter 4 transversely to a pair of shoulders 14*a* and 14*b* protruding from said quarter 4.

The link 13 and the first end 11*b* of the second arm 10 are thus accommodated within an adapted seat 15 formed by the pair of shoulders 14*a* and 14*b*.

The braking element is constituted by a support 16, having wings pivoted, at their ends, to the frame 6 by means of studs or rivets or by means of the pivot of a wheel 7. A pad 18, preferably made of rubber and suitable to interact with the ground, is associated proximate to the base 17 of the support 16.

The first arm 9 and the second arm 10 have, respectively, second ends 19*a* and 19*b* mutually adjacent and externally threaded in opposite directions, so as to allow their coupling to a complimentary threaded sleeve 20. The rotation of the sleeve 20 allows to simultaneously move the first and second arms closer or further apart and thus vary the position of the braking element with respect to the ground.

The link 13 constitutes a kinematic means which allows the backward rotation of the quarter 4, for example to facilitate foot insertion, without activating the braking element 12: in fact, a backward rotation of the quarter 4 can be followed by a clockwise rotation of the link 13 with respect to the first pivot 21, between the pair of shoulders 14*a* and 14*b*, causing the second arm 10 to move in an upper region with respect to the plane of arrangement of said pivot 21.

Advantageously, an elastically deformable element, such as a spring 22 suitable to hold said support raised from the ground, is provided between the frame 6 or the shell 5 and the support 16.

During the use of the skate, in order to avoid rotating the link 13, a second pivot 23 is used transversely to the pair of shoulders 14*a* and 14*b*. The second pivot can be extracted and is arranged proximate to the perimetric edge 24 of the pair of shoulders so that, once it is inserted, it keeps the link adjacent to the quarter 4.

It has thus been observed that the invention has achieved the intended aim and objects. The braking element can be easily deactivated for opening the quarter backwards, for example. The braking action is achieved by the simple backward rotation imparted to the quarter by the user, once the braking element has been reactivated.

The device according to the present invention is naturally susceptible to numerous modifications and variations, all of which are within the scope of the same inventive concept.

Figure 3:
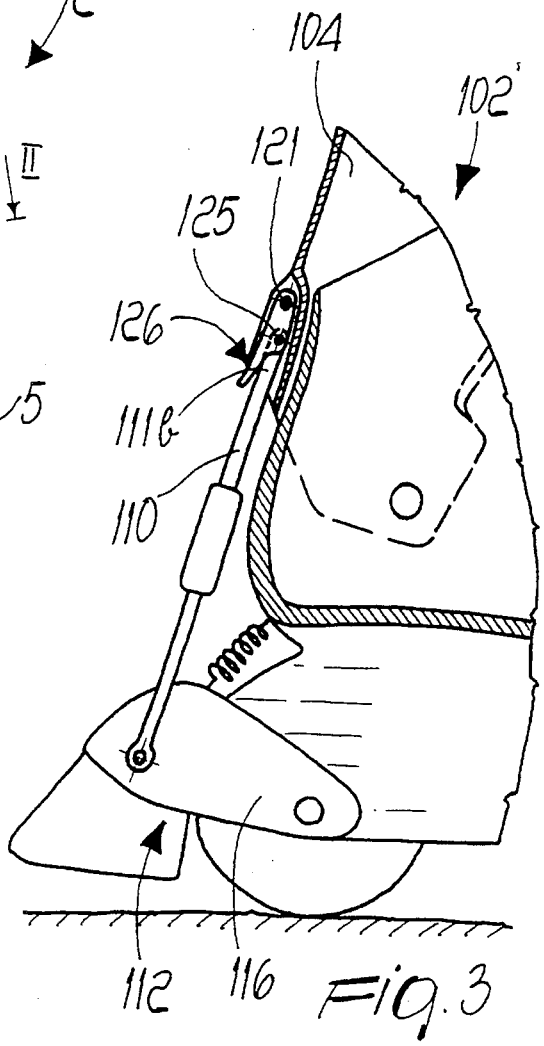
FIG. 3 is a view, similar to FIG. 1, of a further embodiment.
Figure 2:
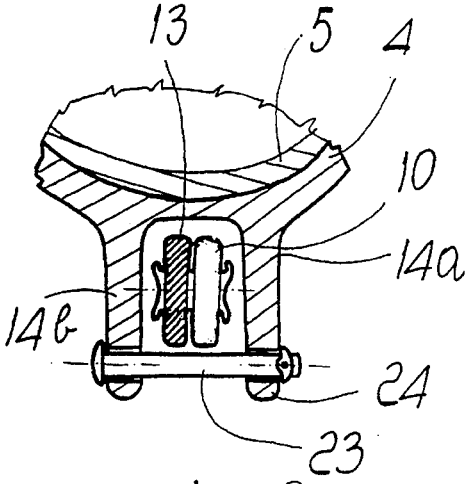
FIG. 2 is a sectional view, taken along the plane II—II of FIG. 1.
Figure 4:
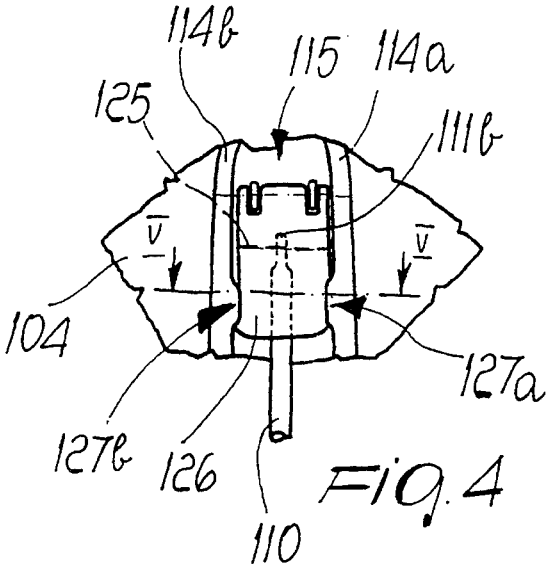
FIG. 4 is a rear view of the shoe of FIG. 3, illustrating the arrangement of the lever.
Figure 5:
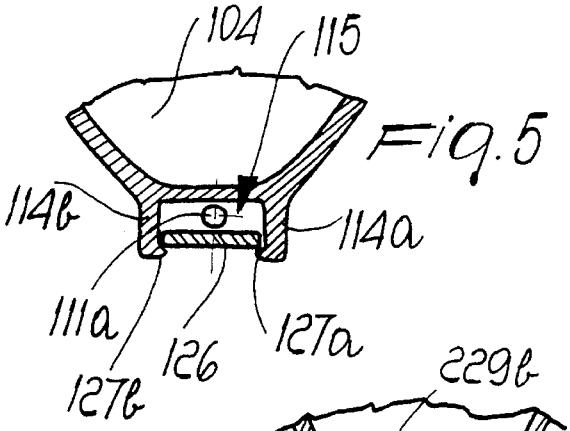
FIG. 5 is a sectional view, taken along the plane V—V of FIG. 4.

Thus, for example, FIG. 3 illustrates a skate 102 according to a further embodiment, wherein the second arm 110 is pivoted, at its first end 111*b*, at a third pivot 125 arranged transversely to the body of a lever 126 which is in turn transversely pivoted, by means of a first pivot 121, in the interspace formed between the pair of shoulders 114*a* and 114*b*.

In this case, in order to easily deactivate the braking element 112, the user merely has to open the lever 126 so as to allow the oscillation of the second arm 110, thus disengaging the kinematic chain for the activation of the braking element 112.

In order to keep the lever 126 in its position during the use of the skate, at the inner lateral surfaces of the pair of wings 114*a* and 114*b* there are adapted elastically deformable tabs 127*a* and 127*b* which allow the snap-action positioning of the body of the lever 126 in or out of the seat 115.

Figure 6:
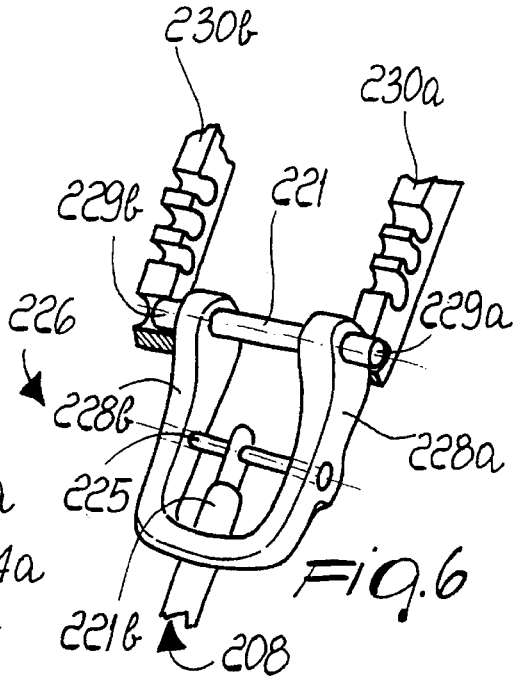
FIG. 6 is a three-quarters partially sectional perspective view of a further embodiment of the lever.
Figure 7:
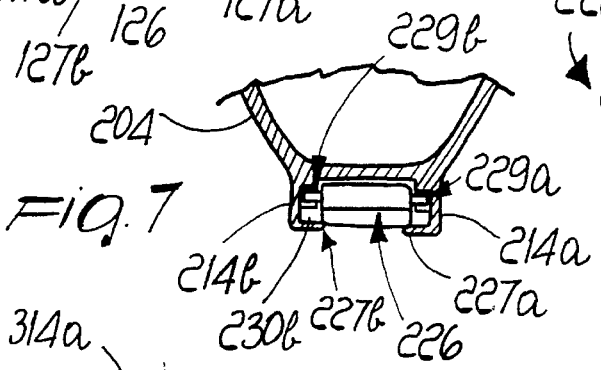
FIG. 7 is a view, similar to FIG. 5, of the solution shown in the preceding figure.

FIGS. 6 and 7 illustrate a further embodiment of the lever 226, which has a pair of wings 228*a* and 228*b* connected by a first pivot 221 at their ends and, approximately in their median region, by a third pivot 225 to which the first end 221*b* of the rod member 208 is freely pivoted.

The first pivot 211 protrudes externally to the wings 228*a* and 228*b*, forming a pair of protrusions 229*a* and 229*b* suitable to engage in a detachable and selective manner complimentary shaped seats of a pair of racks 230*a* and 230*b* associated with the quarter 204 of the skate in a rearward position.

A pair of shoulders 214*a* and 214*b*, suitable to accommodate the lever 226, protrudes to the rear of said quarter 204. Elastically deformable tabs 227*a* and 227*b* protrude from the pair of shoulders and face one another. The tabs 227*a* and 227*b* are adapted to keep the lever 226 adjacent to the quarter 204 during sports practice.

This solution allows to rapidly disengage the rod member from the quarter so as to easily open the quarter, and at the same time allows to rapidly set the rod member 208 in its optimum position for the required activation of the braking element.

Figure 9:
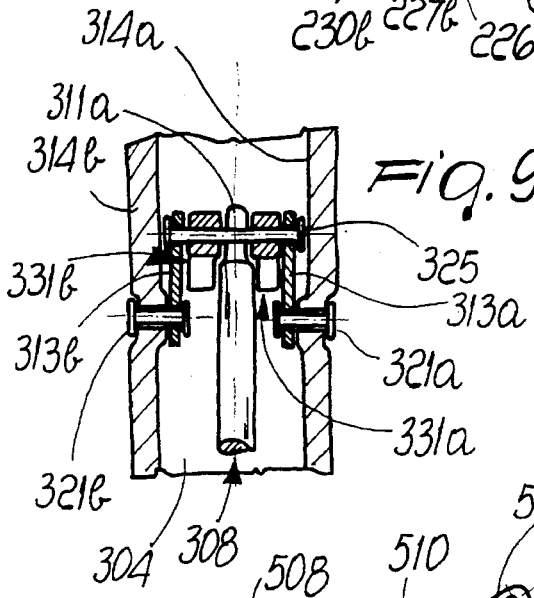
FIG. 9 is a view, similar to FIG. 4, of the embodiment shown in the preceding figure.
Figure 8:
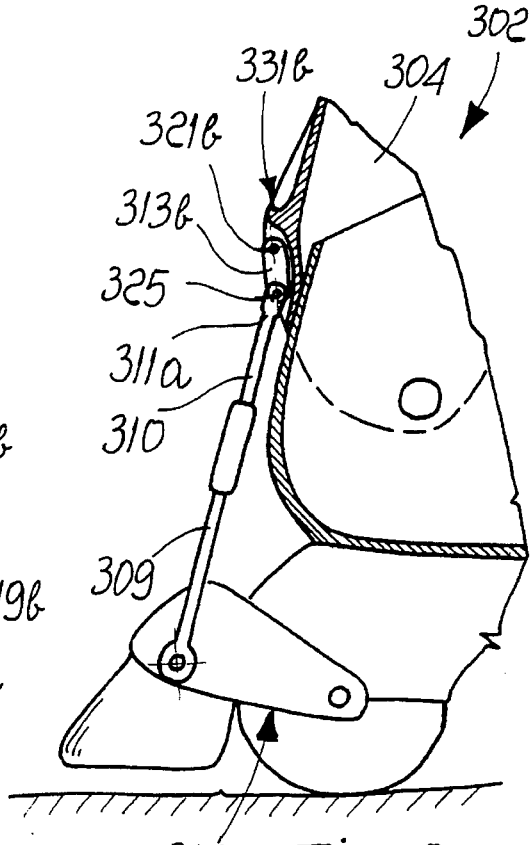
FIG. 8 is a view, similar to FIG. 1, of a further embodiment.
Figure 10:
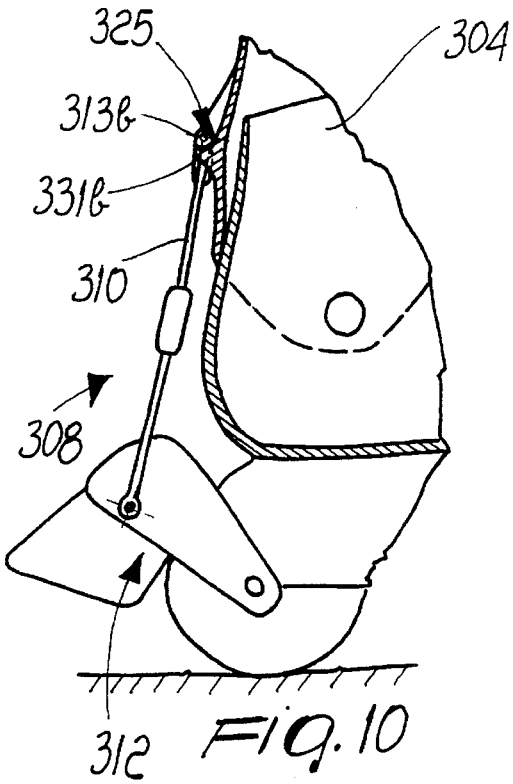
FIG. 10 is a view, similar to FIG. 8, of the braking device with the braking element deactivated.

FIGS. 8, 9 and 10 illustrate a further embodiment of a skate 302 comprising a quarter 304 and a rod member 308 advantageously constituted by a first arm 309 and by a second arm 310 which has a first end 311*a* pivoted, by means of a third pivot 325, to a pair of links 313*a* and 313*b* in turn pivoted, by means of a pair of first pivots 321*a* and 321*b*, to the rear of the quarter 304, transversely to a pair of shoulders 314*a* and 314*b* protruding from the quarter.

The skate also has a means for locking the kinematic systems constituted by the pair of links and for deactivating the braking element 312. The locking means is constituted by a pair of lugs 331*a* and 331*b* protruding to the rear of the quarter 304 in a region located above the pair of first pivots 321*a* and 321*a*, at such a distance as to allow the temporary support, and consequent engagement, of the third pivot 325 on said lugs, as shown in FIGS. 9 and 10.

Figure 11:
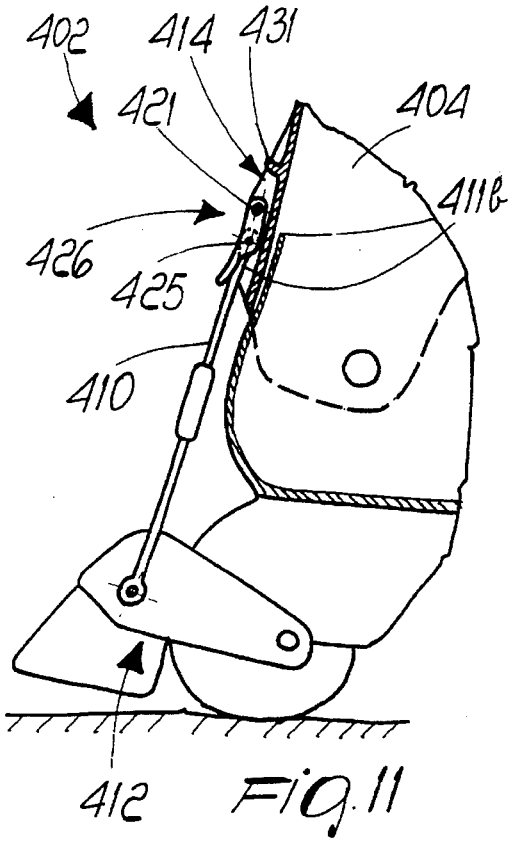
FIG. 11 is a view, similar to FIG. 3, of the use of means for deactivating the braking element.
Figure 12:
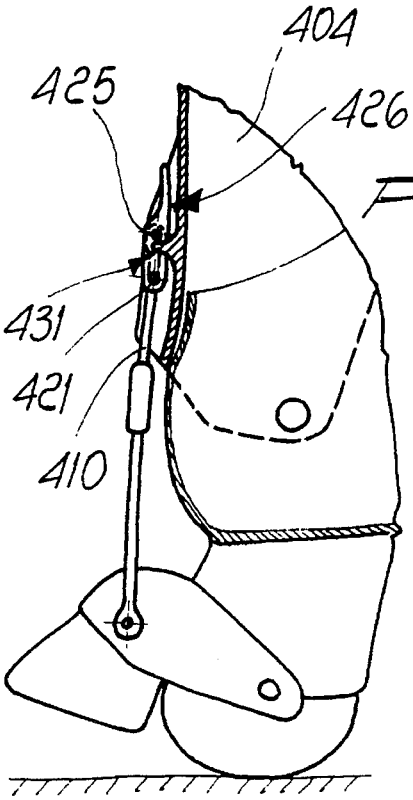
FIG. 12 is a view, similar to the preceding one, in which the braking element is deactivated.

This embodiment, as well as the subsequent embodiment of FIGS. 11 and 12, are particularly advantageous, in that they allow the easy and stable deactivation of the braking element to allow, possibly in addition to the free backward rotation of the quarter for insertion of the foot, also the use of the skate for sports or figure skating, these being specialties in which very extreme movements are performed that the braking element might hinder if it is in its lowered activation position.

In fact, if the bulk of the brake is eliminated and the brake cannot touch the ground, the skate can be used in an optimum manner even for the above mentioned specialties.

FIGS. 11 and 12 illustrate a further embodiment of a skate 402 comprising a quarter 404 in which the second arm 410 is pivoted, at its first end 411*b*, at a third pivot 425 arranged transversely and in an intermediate region of a pair of wings of a lever 426 which is in turn transversely pivoted, at the ends of the wings, by means of a first pivot 421 arranged in the interspace formed between a pair of shoulders 414.

Also this embodiment includes means for locking the kinematic systems constituted by the lever 426 and for deactivating the braking element 412. The locking means is constituted by at least one lug 431 protruding to the rear of the quarter 404 in a region located above the first pivot 421 at such a distance as to allow the temporary support, and consequent engagement, of the third pivot 425 on said lug once the lever 426 has been rotated, as shown in FIG. 12.

Figure 14:
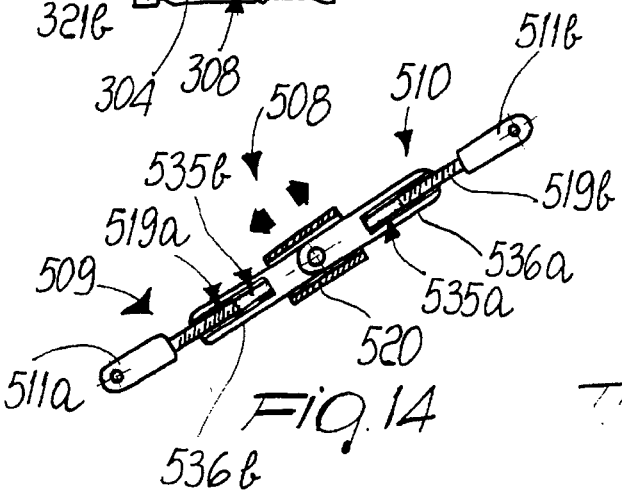
FIG. 14 is a partially sectional view of the shape of the rod member.
Figure 13:
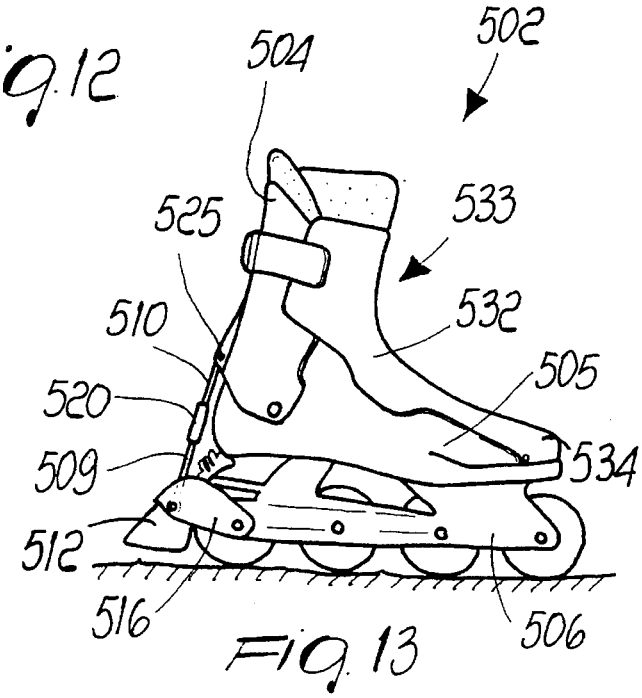
FIG. 13 is a side view of a further embodiment of a skate to which the braking device is applied.
Figure 15:
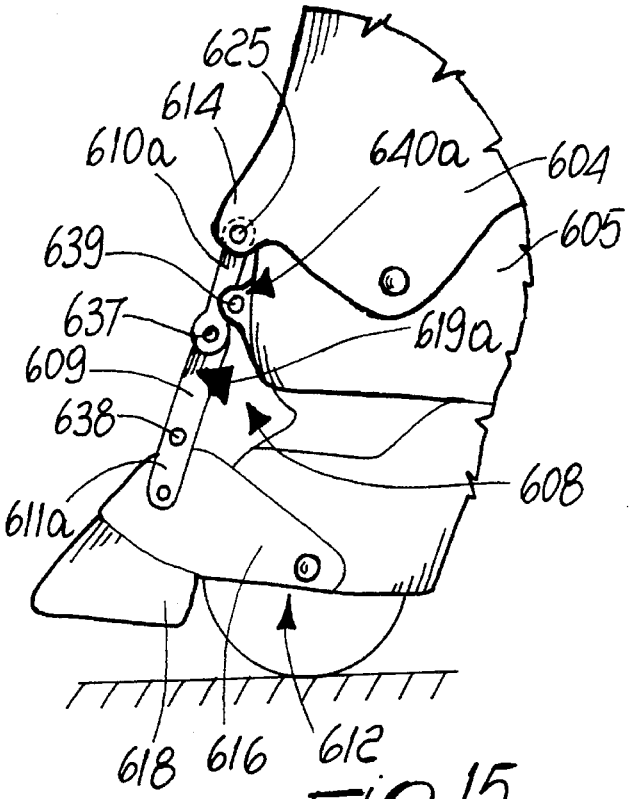
FIG. 15 is a side view of a further embodiment in the condition in which the braking element is activated.
Figure 16:
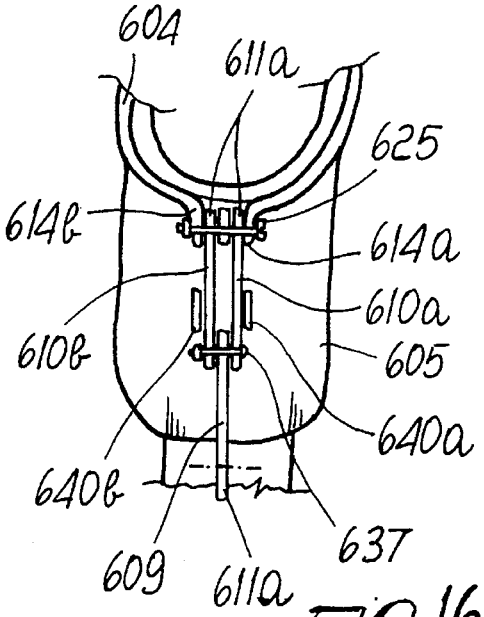
FIG. 16 is a partial rear view of the preceding figure.

FIGS. 13 and 14 illustrate a further embodiment of a skate 502 which comprises a shoe constituted by a rear quarter 504 and by a covering element 532 which surrounds the front part 533 of the leg, of the foot instep and of the metatarsal region.

The rear quarter 504 is articulated to the shell 505 approximately at the malleolar region, whereas the covering element 532 is pivoted to the shell 502 at the toe region 534.

In this solution, the rod member 508 is constituted by a first arm 509 and by a second arm 510 which have first ends 511*a* and 511*b* pivoted respectively to an underlying braking element 512, oscillatably articulated to the frame 506 and to the quarter 504 by means of the third pivot 525.

The first arm 509 and the second arm 510 respectively have second ends 519*a* and 519*b* externally threaded and interacting with complimentary threaded seats 535*a* and 535*b* formed on a pair of mutually articulated rods 536*a* and 536*b*.

A sleeve 520 is slideably arranged coaxially to the pair of rods, and constitutes a means for locking the rods and for deactivating the braking element 512.

This solution, too, allows to deactivate the braking element, as the opening of the rear quarter simply makes the sleeve 520 slide so as to allow the articulation of the pair of rods.

FIGS. 15–18 illustrate a further embodiment, wherein the rod member 608 is again constituted by a first arm 609 pivoted, at its first end 611*a*, at the support 616 of the braking element 612 and pivoted, at its second end 619*a*, by means of a fourth pivot 637, to a pair of second arms 610*a* and 610*b*. The first end 611*a* of the arm 609 is rotatably associated, by means of the third pivot 625, at the pair of shoulders 614*a* and 614*b* protruding from the quarter 604.

The third pivot 625 can be advantageously extracted, allowing to overturn the pair of second arms 610*a* and 610*b* with respect to the fourth pivot 637 and to lock them to the first arm 609, which has an appropriate third hole 638.

However, once the pair of second arms has been disengaged from the pair of shoulders, the fourth pivot 637 can in turn be extracted and repositioned at second holes 639 formed, along the same axis, at a pair of tabs 640*a* and 640*b* protruding from the shell 605 to the rear of said shell in a region underlying the pair of shoulders 614*a* and 614*b*.

Figure 17:
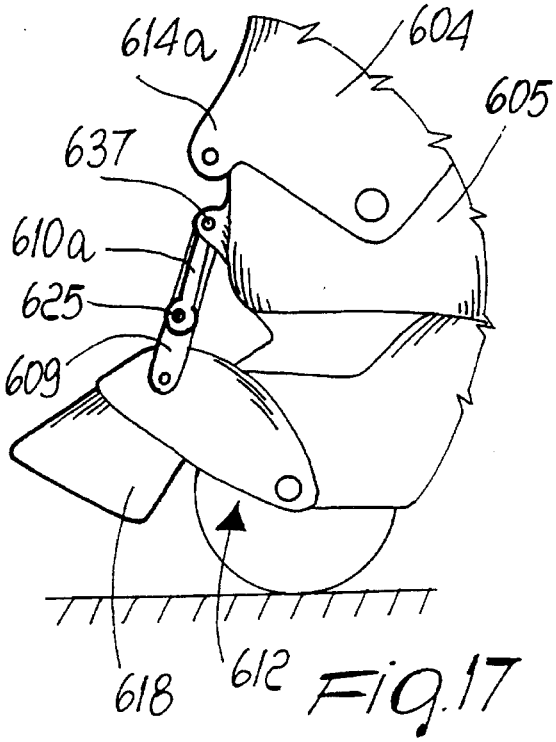
FIG. 17 is a side view of the embodiment of FIG. 15 in which the braking element is deactivated.
Figure 18:
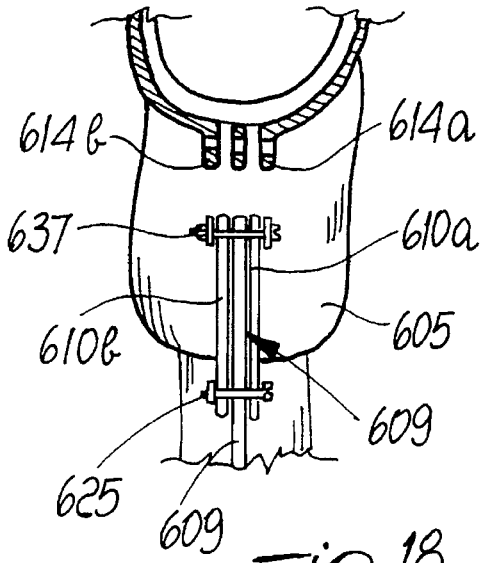
FIG. 18 is a partial rear view of the condition of the preceding figure.
Figure 19:
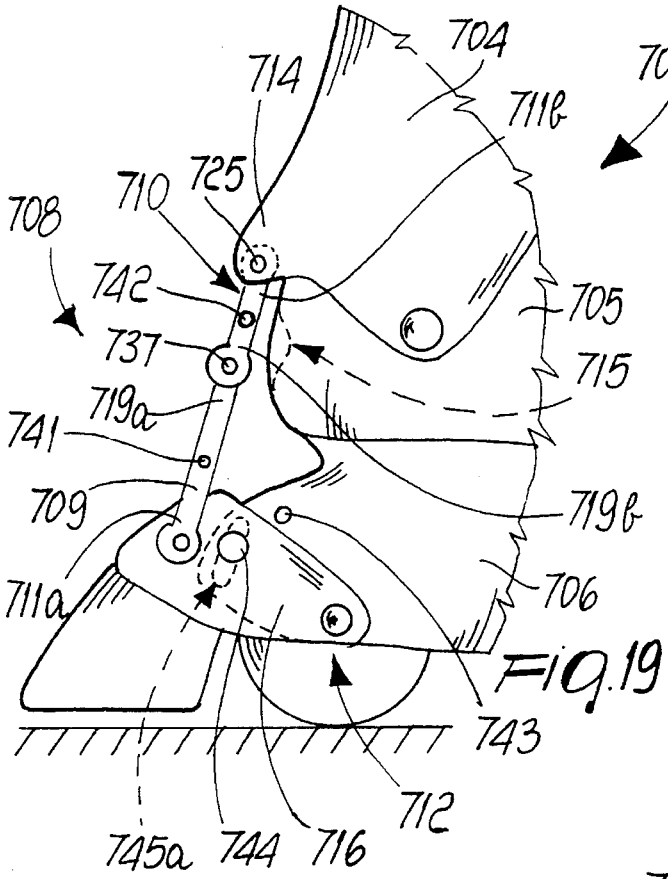
FIG. 19 is a side view of a different solution which the braking element is activated.
Figure 21:
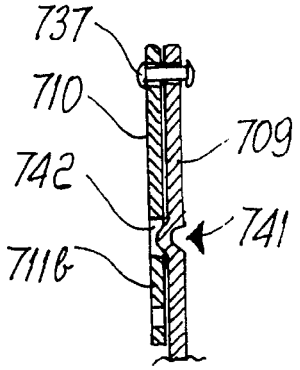
FIG. 21 is a sectional view of an element when the braking element is deactivated.

This condition, illustrated in FIGS. 17 and 18, allows to deactivate the braking element 612, as it is no longer connected to the quarter 604.

Since the pad 618 can no longer interact with the ground, the quarter 604 is consequently free to rotate without friction, deformations and other effects, allowing greater freedom of use of the skate because the bulk of the braking element is practically eliminated.

Therefore, during the practice of particular sports which require frequent flexing and extension, the quarter is free to rotate without moving the braking element, or parts thereof, during this rotation.

FIGS. 19, 20, 21 and 22 illustrate a skate 702, according to a further embodiment, wherein the rod member 708 is constituted by a first arm 709. A first end 711*a* of the first arm 709 is pivoted at the support 716 of the braking element 712, and its second end 719*a* is pivoted to a second arm 710 at a fourth pivot 737. The first end 711*b* of the second arm 710 is pivoted, by means of a third pivot 725, at a pair of shoulders 714 protruding to the rear of the quarter 704.

The third pivot 725 can be extracted, so as to allow rotation of the second arm 710 with respect to the fourth pivot 737 so that it moves adjacent to the first arm 709.

Said first arm advantageously has a means, constituted by a stud 741 protruding laterally from it, for locking said second arm. An adapted third hole 742 formed on the second arm 710 interacts with said stud.

The second ends 719*a* and 719*b* of the first and second arms can also be temporarily arranged, for example by snap-action insertion, within an adapted seat 715 formed on the shell 705 below the region of the pair of shoulders 714 protruding from the quarter 704.

In order to keep the braking element 712 deactivated, a pair of fourth coaxial holes 743 is formed at the frame 706. A fourth pivot 744 can be positioned at said holes and affects additional adapted holes formed at the wings of the support 716.

Figure 22:
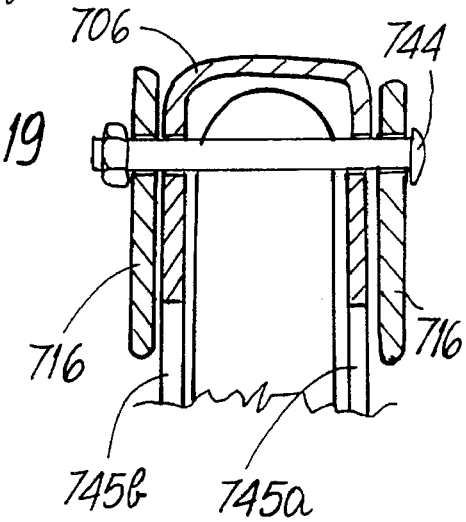
FIG. 22 is a sectional view, taken along the plane XXII—XXII of FIG. 20.
Figure 20:
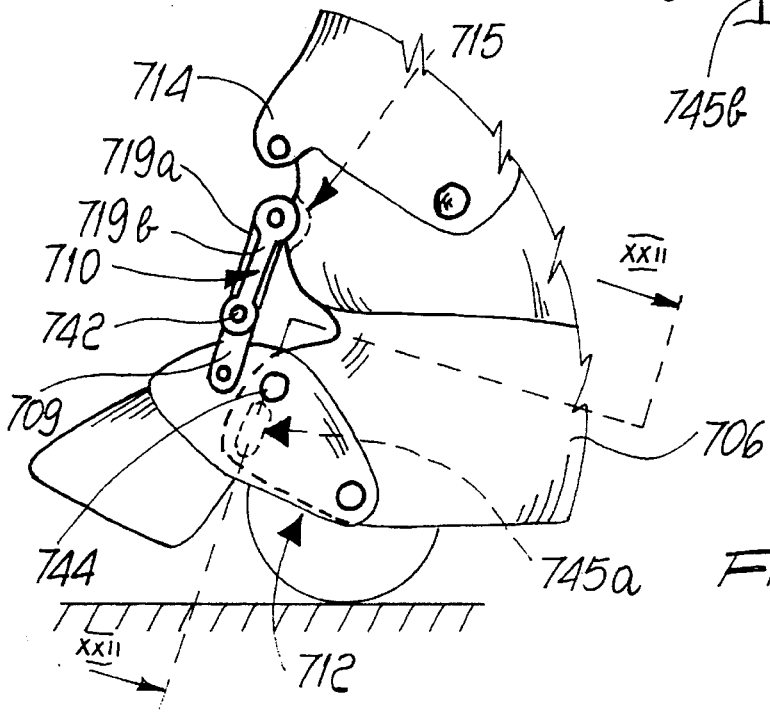
FIG. 20 is a view, similar to the preceding one, in which the braking element is deactivated.

Advantageously, in order to guide the oscillating movement of said support 716, the fourth pivot 744 can affect, when the braking element is activated, an adapted pair of slots 745*a* and 745*b* formed on the frame 706, as shown in FIGS. 20 and 22.

This solution, too, allows to achieve the additional advantages described in the preceding embodiment.

Naturally, the materials and the dimensions which constitute the individual components of the device may be the most pertinent according to the specific requirements.

We claim:

1. Braking device in a skate, the skate comprising a shoe composed of at least one quarter articulated to a shell associated with a supporting frame for a plurality of wheels, the braking. device comprising at least one rod member connected to a braking element, said rod member being operatively connected between said braking element and said quarter through a kinematic means, said kinematic means being adapted to assume a locked position and an unlocked position, said braking element being adapted to interact with a braking surface upon a degree of backward rotation of said quarter when said kinematic means are in said locked position, said kinematic means being suitable to allow said degree of backward rotation of said at least one quarter without activating said braking element against said braking surface when said kinematic means are in said unlocked position, the braking device further comprising releasable locking means for releasably locking said kinematic means in said locked position thereof.

2. Device according to claim 1, wherein said rod member comprises a first arm and a second arm respectively having first ends pivoted to said braking element, and oscillatably articulated to said frame and to a link, said link being pivoted to the rear of said at least one quarter transversely to a pair of shoulders protruding from said quarter.

3. Device according to claim 2, wherein said link and said first end of said second arm are arranged within an adapted seat formed by said pair of shoulders, said first arm and said second arm respectively having second mutually adjacent ends externally threaded in opposite directions so as to allow their coupling to a complimentary threaded sleeve, the rotation whereof allowing to simultaneously move said first arm and said second arm closer or farther apart and thus vary the mutual position of said at least one rod member and said braking element.

4. Device according to claim 2, wherein said link constitutes said kinematic means suitable to allow said degree of backward rotation of said at least one quarter without activating said braking element.

5. Device according to claim 4, wherein an elastically deformable element is provided between said support and either one of said frame and said shell, said elastically deformable element being a spring suitable to keep a pad raised from the ground, said pad constituting said braking element.

6. Device according to claim 2, having, transversely to said pair of shoulders, a second extractable pivot arranged proximate to the perimetric edge of said pair of shoulders so that, once inserted, said second extractable pivot keeps said link adjacent to said at least one quarter.

7. Device according to claim 2, wherein said first end of said second arm is pivoted at a transverse pivot arranged transversely to the body of a lever which is in turn transversely pivoted, by means of a first pivot, in the interspace formed between said pair of shoulders.

8. Device according to claim 7, wherein said lever, in open condition, allows the oscillation of said second arm so as to disengage said kinematic means for the activation of said braking element.

9. Device according to claim 8, wherein said lever is kept in closed position during use of the skate by means of adapted tabs formed at the inner lateral surfaces of said pair of shoulders, said tabs being elastically deformable and being suitable to allow the snap-action arrangement of the body of said lever in or out of a seat formed by said pair of wings.

10. Device according to claim 2, wherein said first end of said second arm is pivoted at a transverse pivot arranged transversely to the body of a lever which is in turn transversely pivoted, by means of a first pivot, in the interspace formed between said pair of shoulders, said lever having a pair of wings connected by said first pivot at their ends and, approximately in the median region, by said transverse pivot to which said first end of said second arm of said rod member is freely pivoted, said first pivot protruding outside said wings so as to form a pair of protrusions suitable to detachably and selectively engage complimentarily shaped seats of a pair of racks associated with said at least one quarter of said skate in a rearward position thereof.

11. Device according to claim 2, wherein said second arm is pivoted, at said first end thereof, at a transverse pivot arranged transversely to, and in an intermediate region of, a pair of wings of a lever which is in turn transversely pivoted, at the ends of said wings, by means of a first pivot arranged in the interspace formed between a pair of shoulders protruding to the rear of said at least one quarter.

12. Device according to claim 11, wherein said kinematic means comprise said lever and wherein said locking means are formed by at least one lug protruding to the rear of said at least one quarter in a region arranged above said first pivot at such a distance as to allow the temporary support, and consequent engagement, of said transverse pivot on said lug once said lever has been rotated.

13. Device according to claim 1, wherein the first end of said second arm is pivoted, by means of a transverse pivot, to a pair of links which is in turn pivoted, by means of a pair of first pivots, to the rear of said at least one quarter transversely to a pair of shoulders protruding from said quarter.

14. Device according to claim 13, wherein said locking means comprise a pair of lugs protruding to the rear of said at least one quarter in a region located above said pair of first pivots at such a distance as to allow the temporary support, and consequent engagement, of said transverse pivot on said lugs.

15. Device according to claim 1, wherein said at least one quarter comprises a rear quarter, the skate further comprising a covering element for surrounding the front part of the leg, of the foot instep and of the metatarsal region of a user, said rod member comprising a first arm and a second arm which have first ends pivoted, respectively, to an underlying braking element oscillatably articulated to said frame and to said quarter by means of said connecting pivot, said first arm and said second arm having, respectively, second externally threaded ends which interact with complimentarily threaded seats formed on a pair of mutually articulated rods.

16. Device according to claim 15, wherein a sleeve is slideably arranged coaxially to said pair of rods and constitutes said locking means by being adapted for locking said rods.

17. Device according to claim 1, wherein said rod member comprises a first arm having a first end connected to said braking element and a pair of mutually arranged second arms, said first arm having a second end which is rotatably connected to second ends of said second arms by means of a connecting pivot first ends of said second arms being rotatably associated, by means of a transverse pivot, at a pair of shoulders protruding from said quarter.

18. Device according to claim 17, wherein said transverse pivot is extractable so as to allow to overturn said pair of second arms on said first arm, said second ends of said pair of second arms being temporarily associable with said first arm by means of said transverse pivot, which passes through an adapted hole formed on said first arm.

19. Device according to claim 18, wherein a pair of wings protrudes below said pair of shoulders to the rear of said shell and is provided with second coaxial holes which act as seats for the temporary insertion of said connecting pivot suitable to lock said first arm and said pair of second arms to said shell, thereby deactivating said braking element.

20. Device according to claim 1, wherein said rod member comprises a first arm and a second arm, said first arm having a first end connected to said braking element and a second end rotatably connected, by means of a connecting pivot, to a second end of said second arm, a first end of said second arm being rotatably associated, by means of said transverse pivot, at a pair of shoulders protruding from said quarter.

21. Device according to claim 20, wherein said transverse pivot is extractable to allow the overturning of said second arm on said first arm, which has a means for the temporary locking of said second arm, said means for temporary locking comprising by a stud protruding laterally from said first arm and with which an adapted hole formed on said second arm interacts.

22. Device according to claim 21, wherein the second ends of said first arm and of said second arm can be temporarily arranged within a seat formed on said shell below said pairs of shoulders protruding from said quarter.

23. Device according to claim 22, wherein a sliding pivot is transversely associated on wings of said support of said braking element and can slide within a pair of curved slots formed on said frame.

24. Device according to claim 23, wherein said sliding pivot can be arranged selectively within coaxial holes formed on wings of said frame in a region above said pair of slots, so as to lock the oscillation of said braking element.

* * * * *